US008192606B2

(12) United States Patent
Haglund

(10) Patent No.: US 8,192,606 B2
(45) Date of Patent: Jun. 5, 2012

(54) DEVICE AND A METHOD FOR METAL PLATING

(75) Inventor: Jan Haglund, Borlänge (SE)

(73) Assignee: ABB Technology Ltd., Zürich (CH)

( * ) Notice: Subject to any disclaimer, the term of this patent is extended or adjusted under 35 U.S.C. 154(b) by 988 days.

(21) Appl. No.: 12/158,743

(22) PCT Filed: Dec. 19, 2006

(86) PCT No.: PCT/SE2006/050596

§ 371 (c)(1),
(2), (4) Date: Jun. 23, 2008

(87) PCT Pub. No.: WO2007/073339

PCT Pub. Date: Jun. 28, 2007

(65) Prior Publication Data

US 2008/0296150 A1 Dec. 4, 2008

(30) Foreign Application Priority Data

Dec. 22, 2005 (SE) ..... 0502893

(51) Int. Cl.
*C25D 5/16* (2006.01)

(52) U.S. Cl. ..... 205/95; 205/117; 205/118; 205/263; 204/280

(58) Field of Classification Search ..... 205/95, 205/117

See application file for complete search history.

(56) References Cited

U.S. PATENT DOCUMENTS

| | | | | |
|---|---|---|---|---|
| 2,395,044 | A * | 2/1946 | Gorton | 42/76.01 |
| 4,432,845 | A * | 2/1984 | Ogata et al. | 205/156 |
| 4,952,296 | A | 8/1990 | Wingenfeld et al. | |
| 5,190,486 | A | 3/1993 | Tsuk | |
| 5,322,614 | A | 6/1994 | May et al. | |
| 5,453,174 | A * | 9/1995 | Van Anglen et al. | 205/117 |
| 5,476,581 | A * | 12/1995 | Reckeweg et al. | 205/122 |
| 2004/0045837 | A1 * | 3/2004 | Yoshida et al. | 205/668 |

FOREIGN PATENT DOCUMENTS

EP 0084752 A1 8/1983

(Continued)

OTHER PUBLICATIONS

Machine Translation of EP 0084752 A1.*

(Continued)

*Primary Examiner* — Harry D Wilkins, III
*Assistant Examiner* — Bryan D. Ripa
(74) *Attorney, Agent, or Firm* — Venable LLP; Eric J. Franklin

(57) ABSTRACT

A device and a method for metallic electrolytic coating of an object of electrically conductive material, wherein the object has at least two surface portions that are desired to be coated with layers of different thicknesses. The device includes an anode. The device is designed to receive the object in such a way that the object constitutes a cathode and that, upon receipt of the object, a space is formed for receiving a liquid-absorbing material and an electrolyte for coating the object. The body of the anode includes at least two surface portions) that have different electrical conductivity and that are arranged opposite to the surface portions of the received object.

16 Claims, 3 Drawing Sheets

FOREIGN PATENT DOCUMENTS

| | | | |
|---|---|---|---|
| EP | 84752 | A1 * | 8/1983 |
| GB | 566706 | | 1/1995 |
| JP | 11229181 | A * | 8/1999 |

OTHER PUBLICATIONS

Machine Translation of JP 11-229181.*
AV Bertil Stommendal och P-O Blomqvist; Borstplatring Eller Selektiv Platering; Kapitel 23; pp. 410-416, 1994.
PCT/ISA/210—International Search Report—Mar. 21, 2007.
PCT/ISA/237—Written Opinion of the International Searching Authority—Mar. 21, 2007.
PCT/IPEA/409—International Preliminary Report on Patentability—Nov. 15, 2007.
Supplementary search report issued by European patent office in counterpart application 06835950.4, Feb. 28, 2011.

* cited by examiner

DEVICE AND A METHOD FOR METAL PLATING

CROSS-REFERENCE TO RELATED APPLICATIONS

This application claims priority to Swedish patent application 0502893-1 filed 22 Dec. 2005 and is the national phase under 35 U.S.C. §371 of PCT/SE2006/050596 filed 19 Dec. 2006.

TECHNICAL FIELD

The present invention relates to a device and a method for coating an electrically conductive material with a layer of metal. Such a device and such a method are useful, for example, for coating of metal on metal components.

BACKGROUND OF THE INVENTION

It is well known that a conductive object that is immersed into a bath containing a metallic salt solution may acquire a metallic coat when the object constitutes a cathode in an electric circuit during current supply. A coating will be obtained in the whole surface exposed to the metallic salt solution. If it is desired to locate the coating at a smaller region, so-called brush plating is often used, whereby the electrolyte is located at a certain region with the aid of a liquid-absorbing material. Only the region that is in contact with the liquid-absorbing material will then be coated. Examples of such liquid-absorbing materials are rubber sponge and cloth of so-called Scotch-Brite®. Because of the high current densities that are used, brush plating takes place under relative movement between anode and cathode. Too slow a relative movement may cause burn-in effects on the layer, whereas too fast a relative movement may cause an unnecessarily slow rate of coating. The layer thickness obtained depends on the concentration of metal ions in the salt solution and the electric energy supplied. The electric energy supplied may, for example, be expressed as the electric current multiplied by time, for example expressed in Ah.

Brush plating is described, for example, in "Lärobok i Elektrolytisk och Kemisk Ytbehandling" ("*Textbook in Electrolytic and Chemical Surface Treatment*"), volume 1, published by Ytforum/G Ekström's publishing house, Linköping 1994, pp. 410-416. If different portions of the conductive object are to be coated with layers of different thickness, the coating must take place in steps where each region is coated separately. When rotationally symmetrical objects such as, for example, tubes are to be coated with layers of different thickness on different places, masking is used such that those parts that are not to be coated to layer thickness A are masked, whereas those parts which are to be coated to layer thickness A are exposed, whereupon those parts which have layer thickness A are masked and those parts which are to receive layer thickness B are exposed. For each desired layer thickness, at least one process step is added. When several different parts are to be coated with layers of different thickness, the process is complicated and time-wasting. The probability of errors increases with the number of process steps, and the costs of rejections may be considerable.

OBJECT OF THE INVENTION

It is an object of the present invention to make it possible to coat a component, in one single step, with layers of metal of different thicknesses.

SUMMARY OF THE INVENTION

According to a first aspect of the invention, the above object is achieved with a device. The device according to the invention comprises an anode that has a body, the device being designed to receive an object in such a way that the object constitutes an anode and that, when receiving the object, a space is formed for receiving a liquid-absorbing material and an electrolyte for coating the object, the body of the anode comprising at least two surface portions with different electrical conductivity which are arranged opposite to surface portions which are to be coated with layers of different thicknesses. The thickness of the layer may be varied from zero and upwards. By electrical conductivity is meant an electrical conductivity that may be varied from zero, or near zero, and upwards. It may be desirable that certain surface portions on the object should remain uncoated whereas others should be coated with a layer. Where it is desired that a surface portion of the object should remain uncoated, an anode is used which has an opposite surface portion with no, or very low, conductivity.

Experiments have shown that the rate of growth of the layer on the object is dependent on the electrical conductivity of that surface of the anode which is opposite to the object. Since different surface portions have different electrical conductivity, opposite surface portions of the object are allowed to experience different rates of coating and, after a given coating time, also different layer thicknesses. Thus, the object may be advantageously coated with different layer thicknesses on different places in one and the same process step. For a rotationally symmetrical object, the layer thickness in the longitudinal direction may be varied by giving the opposite surface portion on the anode a different electrical conductivity. Also the supply of electrolyte, for example expressed in supply volume per unit of time, is important for the rate of growth on the layer. Since the layer thickness on different parts of the object may easily be adapted according to the technical requirement, the consumption of metal can be minimized, which is advantageous from the point of view of cost.

According to a preferred embodiment of the invention, the surface of the anode is rotationally symmetrical. In this way, a rotationally symmetrical object may have rotationally symmetrical layers of different thicknesses in the longitudinal direction.

According to a preferred embodiment of the invention, the electrolyte is distributed out into the space between the anode and the object through at least one channel in the anode.

In a further embodiment of the invention, the electrolyte is distributed out into the space between the anode and the object through several channels. The anode comprises at least two channels for the supply of electrolyte out onto the surface of the anode, one of these channels opening out into one of said surface portions and the other channel opening out into the other of said surface portions. One of the channels has a cross-section area that is smaller than the cross-section area of the other channel. This embodiment permits different surface portions to be supplied with different quantities of electrolyte per unit of time. The channels are designed such that the supply of electrolyte to different parts of the surface of the anode takes place while taking into consideration the layer thickness that is to be attained on that surface of the object that is opposite to the anode. A faster rate of growth of the layer, at a given current supply and concentration of metal ions in the electrolyte, requires a larger supply of electrolyte and therefore the cross-section area of the channel will be larger than for a lower rate of growth.

According to still another preferred embodiment of the invention, the anode and the object are adapted to rotate relative to each other. The relative movement during the coating gives a good quality of the layer and burning-in of the layer is avoided.

According to yet another preferred embodiment, said device comprises means for carrying out degreasing of the object to be surface-coated. Preferably, the channels of the anode are utilized for distribution of degreasing liquid out into the space between the anode and the object and further out through the liquid-absorbing material to the surface of the object. One example of a degreasing liquid that may be used is a sodium hydroxide solution. One advantage of this embodiment is that the same device may be utilized for both degreasing and metal plating. The object to be coated need never be moved between the different stages.

According to still a further embodiment of the invention, the device comprises means for carrying out pickling, or so-called activation, of the surface on which a metal coat is to be applied. It is carried out in order for a subsequent coating to have good adhesion. Preferably, the channels of the anode are utilized for distribution of pickling liquid out in the space between the anode and the object and further out through the liquid-absorbing material to the surface of the object. The pickling liquid may, for example, consist of a sulphuric acid solution. The pickling liquid is in a tank that is connected to the device, and in order to drive the flow of pickling liquid a pump is connected between the tank and the device. When the pickling liquid has passed through the device, it is returned to the tank. During pickling, the current supply is zero or very small. One advantage of this embodiment is that the same device may be utilized for both pickling and metal plating. It is also advantageous to combine this embodiment with the previous embodiment where the device comprises means for carrying out degreasing. In this way, the same device may be utilized for degreasing, pickling as well as metal plating. The objects to be coated need never be moved between the different stages.

According to yet a further embodiment of the invention, one of the surface portions of the anode has a conductivity that is zero, or near zero, and another of the surface portions of the anode has a conductivity that is significantly greater than zero.

According to an additional embodiment of the invention, one of the surface portions of the anode has a first conductivity that is significantly greater than zero, and another of the surface portions of the anode has a second conductivity that is significantly greater than zero, whereby the first conductivity differs from the second conductivity.

According to a second aspect of the invention, this object is achieved with a method. Such a method comprises the object being received by the device, whereby a space is formed between said anode and the received object, said surface portions being positioned opposite to surface portions on the anode which have different electrical conductivity, liquid-absorbing material being added to said space, electrolyte being supplied to the space, at least one of said surface portions being electrified, whereby coating to different layer thicknesses of said surface portions of the object is carried out.

A preferred embodiment of the method comprises supplying electrolyte through at least two channels, whereby the volume of flow per unit of time is smaller in one of said channels compared with the other of said channels. In this way, different surface portions are supplied with electrolyte of different amounts, whereby the rate of coating becomes different for the different surface portions.

According to one embodiment of the invention, an electrolyte comprising a metallic salt solution is added. The solution may be purely inorganic, for example a metal-cyanide solution. One example of a metal-cyanide solution is a solution of silver cyanide in water. The electrolyte may also be organometallic. A mixture of an inorganic and an organometallic solution may also be used.

A particularly useful application of the invention is internal and external coating of rotationally symmetrical components. Examples of such components are thin-walled and thick-walled tubes for various use, cylinders bored up into pieces of material, shafts as well as bar stock for, for example, operating arms. Other applications may be coating of smaller tanks, equipment for water-distribution systems and components for chemical process plants. The invention makes it simple to apply different layer thicknesses on different surface portions of the object, so objects which were previously considered not to be suitable for coating, for cost reasons, can now be coated in an advantageous way.

BRIEF DESCRIPTION OF THE DRAWINGS

The present invention will now be explained in greater detail by means of different embodiments and with reference to the accompanying drawings.

DESCRIPTION OF THE PREFERRED EMBODIMENTS

Figure 1A:
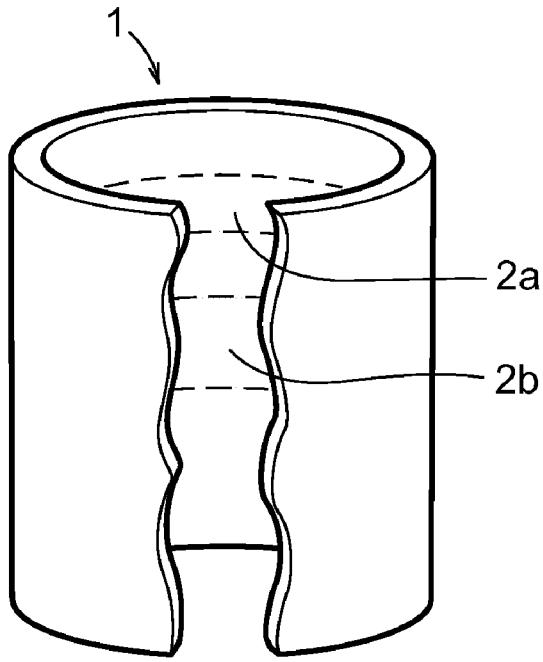
FIG. 1*a* shows an example of an object intended to be coated with a device according to the invention.

FIG. 1*a* shows a tubular object 1 intended for electrolytic coating on the inside of the object, wherein it is desired that different surface portions 2*a-b* of the object be coated with layers of different thicknesses. In this example, two portions 2*a-b* of the object are to be coated with layers with different thicknesses, whereas the rest of the surface of the object is not to be coated.

Figure 1B:
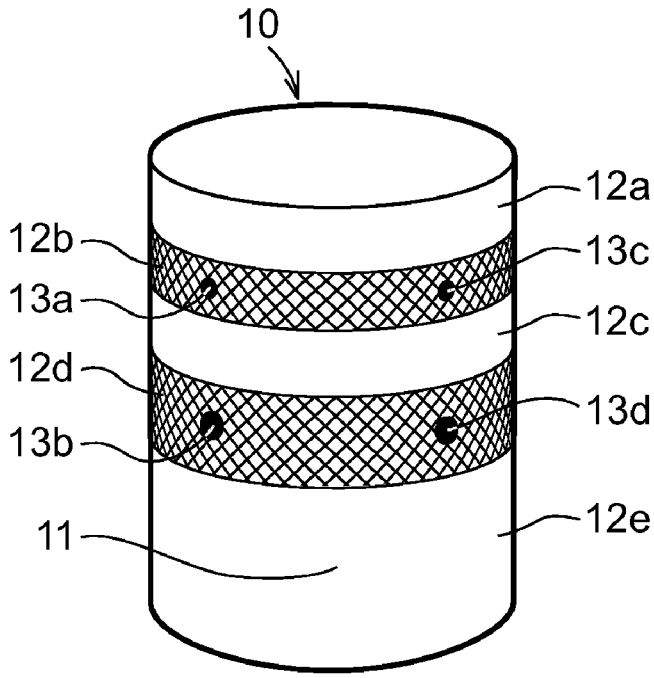
FIG. 1*b* shows an example of an anode in a device according to the invention.

FIG. 1*b* shows an anode 10 intended to be used for electrolytic coating on the inside of the tubular object 1. The anode 10 constitutes an electrical positive pole during the electrolytic coating of the object. The anode 10 comprises a cylindrical body 11 which has a plurality of surface portions 12*a-e* with different electrical conductivity. The surface portions 12*a*, 12*c*, 12*e* lack conductivity and correspond to those portions of the object which are not to be coated. The surface portions 12*b* and 12*d* are electrically conductive and correspond to those portions 2*a* and 2*b* on the object which are to be coated with layers. In this example, the surface portions 12*b* and 12*d* have the same conductivity. The surface portions 12*b* and 12*d* may also have different conductivity in another embodiment, whereby layers with different layer thicknesses are obtained. The difference in conductivity between the surface portions 12*b* and 12*d* reflects the desired difference in layer thickness between corresponding portions of the object. A high conductivity of the surface portion gives a thicker layer than a low conductivity. The shape and size of the surface portions 12*a-e* are determined by the shape and size of those surface portions of the object which it is desired to coat. Each new coating geometry of an object requires a new configuration of the surface portions of the anode.

The surface portions 12*a*, 12*c*, 12*e* are made of an electrically insulating material that has good chemical resistance and workability. Examples of such materials are Teflon® (PTFE) and polyvinylidene fluoride (PVDF). The surface portions 12*b*, 12*d* are made of an electrically conductive material that has good chemical resistance, sufficiently good strength and stiffness and a suitable electrical conductivity. Examples of such materials are stainless steel, titanium alloys, and platinum.

One way of manufacturing the anode is to apply a layer with a first electrical conductivity onto a body with a second electrical conductivity, where the layers correspond to the desired surface layer on the object. In one embodiment the body may consist of a material with good electrical conductivity, for example stainless steel, whereby the layers consist of material with another electrical conductivity, for example an electrically insulating material. In another embodiment, the body may consist of an electrically insulating material, for example Teflon®, whereby the layers consist of material with a higher electrical conductivity, for example stainless steel.

In this embodiment, the anode is manufactured by turning a blank into a diameter that is suitable for the object to be surface-coated. This diameter is between 2 and about 20 mm smaller than the diameter of the rotationally symmetrical object to be surface-coated. The locations for the surface portions on the body of the anode are turned down approximately 1 mm. An axially cut tube, for example a plastic tube, with a thickness of 1 mm and with an outside diameter equal to that of the blank, before turning down to receive the tube, and an axial height equal to that of the turned-down region on the blank, is fitted and the cut is joined together, for example by gluing. The surface portions 12*b*, 12*d*, which have retained the original blank diameter, have the same electrical conductivity as the blank.

In another embodiment, the anode comprises a plurality of concentric annular elements with different electrical conductivity. These elements are fitted onto an elongated rotationally symmetrical support element, for example a rod. The elements have surfaces which together form the outer surface of the anode. The surfaces of the elements thus form surface portions with different electrical conductivity. The advantage of this embodiment is that it is simple to change elements and thus adapt the size of the surface portions of the anode and to change the location of the surface portions on the anode to adapt the anode to coating of the object with a different surface configuration.

Further, the anode comprises a plurality of channels 13*a-d* for the supply of electrolyte. The channels have outlets that open out on the surface of the anode, more particularly in the surface portions that are electrically conductive, 12*b*, 12*d*. The anode also has the function of constituting structurally supporting elements for the channels 13*a-d* and their outlet on the surface of the anode.

The body 11 may be a solid rotationally symmetrical cylinder in which channels 13*a-d* have been worked out, the outlets of which open out on the outside of the anode. The body 11 may also be shaped as a rotationally symmetrical tube with channels 13*a-d* built up on the inside of the tube.

The electrically conductive surface portions are galvanically connected to the positive pole of a current unit. Upon energization, all electric current will be channeled to the electrically conductive surface portions 12*b*, 12*d* whereas no current will be channeled to the electrically insulated surface portions 12*a*, 12*c*, 12*e*.

Figure 2:
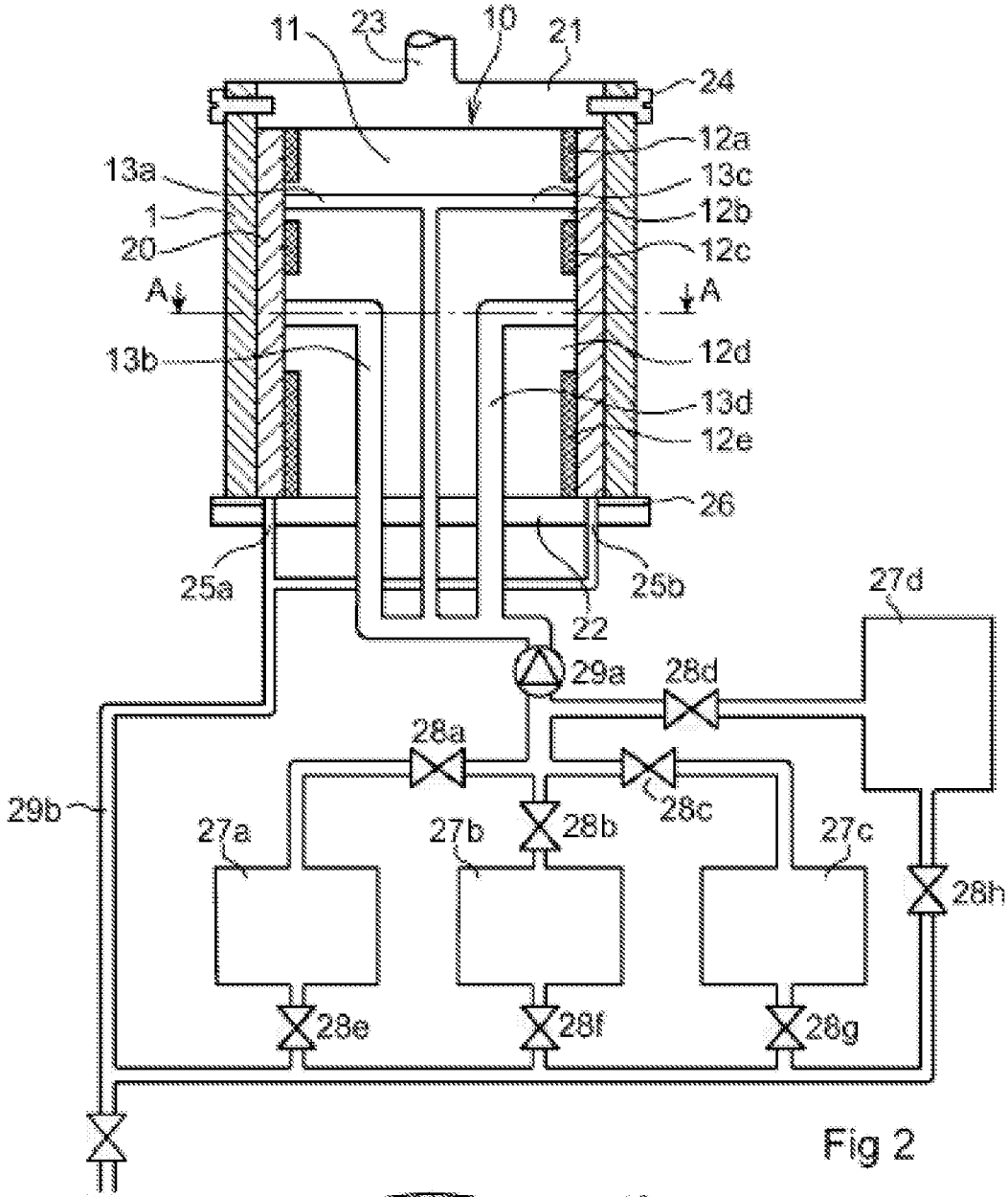
FIG. 2 is an axial cross section through a device according to one embodiment of the invention.
Figure 3:
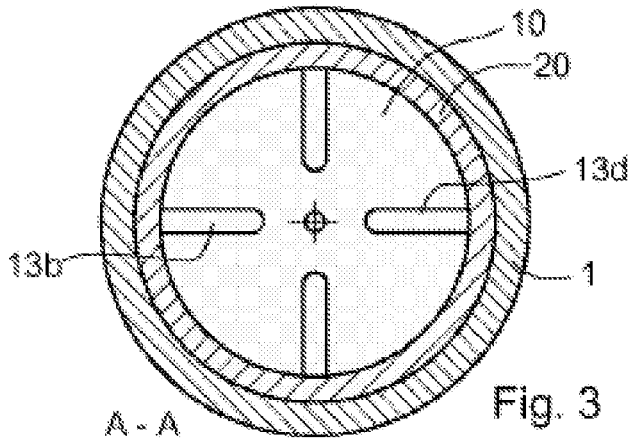
FIG. 3 is a transversal cross section A-A through the device of FIG. 2.

FIG. 2 shows an axial cross section of a device according to one embodiment of the invention. FIG. 3 shows a transversal cross section A-A through the device of FIG. 2. The device comprises an anode that has a cylindrical body 11, of the type that is clear from FIG. 1*b*, and is intended to receive the rotationally symmetrical object 1, shown in FIG. 1*a*, which is to be coated. The object is coated on the inside. In the anode, four channels 13*a-d* have been worked out, through which electrolyte is supplied to the surface of the anode. These channels open out at those surface portions of the anode which are not insulated. Since the channels 13*a-d* open out at those surface portions which are electrically conductive, it is ensured that fresh electrolyte is supplied to those surface portions which are to be coated. In this embodiment, the channels 13*a*, 13*c* have a cross-section area that is smaller than the cross-section area of the channels 13*b*, 13*d*.

The object is placed relative to the anode in such a way that the surface portions that are to be coated will be opposite to those surface portions of the anode which are electrically conductive. The device is designed to receive the object in such a way that the object constitutes a cathode and that, when receiving the object, a space 20 is formed for receiving a liquid-absorbing material and an electrolyte for coating the object. The liquid-absorbing material may, for example, comprise a cloth of so-called Scotch-Brite®. The thickness of this cloth is determined by the width of the space. The cloth is intended to fill up the space 20 that is formed between the anode and the object to be surface-coated. Further, the cloth is intended to receive and make available fresh electrolyte at those surface portions which are to be surface-coated. Electrolyte may advantageously comprise a metallic salt solution. The solution may be purely inorganic, for example a metal-cyanide solution. Examples of a metal-cyanide solution is a solution of silver cyanide in water. The electrolyte may also be organometallic. A mixture between inorganic and organometallic solution may also be used. The surplus of electrolyte is drained through drainage holes 25*a-b* provided in the lower part of the device.

The object is enclosed by a cover 21 and a bottom plate 22. The cover 21 is provided with a tap hole 23 and is connected to the object to be surface-coated by means of bolts 24. The object is brought to rotate relative to the anode by introducing a rotary motion via the tap 23. The tubular object is sealed against, and electrically insulated from, the bottom plate 22 by an annular rubber element 26. The anode is in galvanic contact with the bottom plate. The bottom plate 22 and hence the anode 10 are connected to the positive pole of a dc unit and the object 1 is connected to the negative pole on the same unit.

The device shown in FIG. 2 also comprises means for carrying out degreasing of the object to be coated. These means comprise a tank 27*a* intended to contain degreasing liquid. The tank is connected via lines to the channels 13*a-d* of the anode. The supply of degreasing liquid to the anode is controlled by a valve 28*a* arranged in the line to the anode.

The device shown in FIG. 2 also comprises means for carrying out pickling of the object to be coated. These means comprise a tank 27*b* intended to contain pickling liquid. The tank is connected via lines to the channels 13*a-d* of the anode. The supply of pickling liquid to the anode is controlled by a valve 28*b* arranged in the line to the anode.

The device shown in FIG. 2 also comprises means for carrying out rinsing of the object to be coated. These means comprise a tank 27*d* intended to contain water. The tank is connected via lines to the channels 13*a-d* of the anode. The supply of water to the anode is controlled by a valve 28*d* arranged in the line to the anode.

The device shown in FIG. 2 also comprises means for supplying electrolyte for coating the object. These means comprise a tank 27*c* intended to contain electrolyte. The tank is connected via lines to the channels 13*a-d* of the anode. The supply of electrolyte to the anode is controlled by a valve 28*c* arranged in the line to the anode.

The device further comprises a pump 29*a* connected between the valves 28*a-d* and the channels 13*a-d* of the anode for driving the liquid flow.

The device further comprises a drain line 29*b* connected between the drainage holes 25*a-b* and the tanks 27*a-d* for returning liquid. The drain line is connected to the tanks 27*a-d* and is provided with a number of valves 28*e-h* for controlling the return of liquid to the respective tank 27*a-d*.

Figure 4:
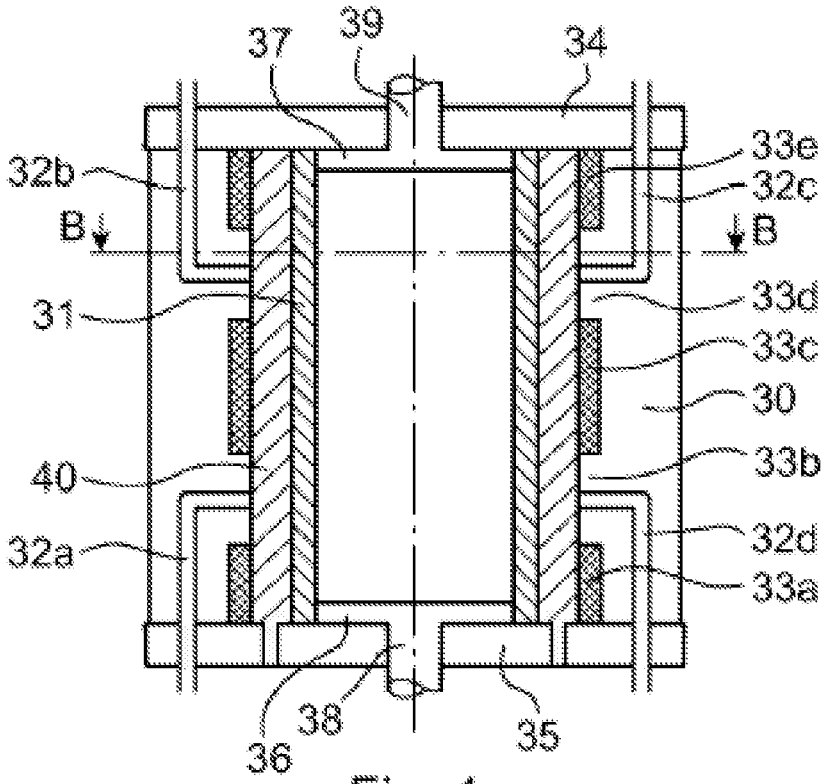
FIG. 4 is an axial cross section through a device according to another embodiment of the invention.
Figure 5:
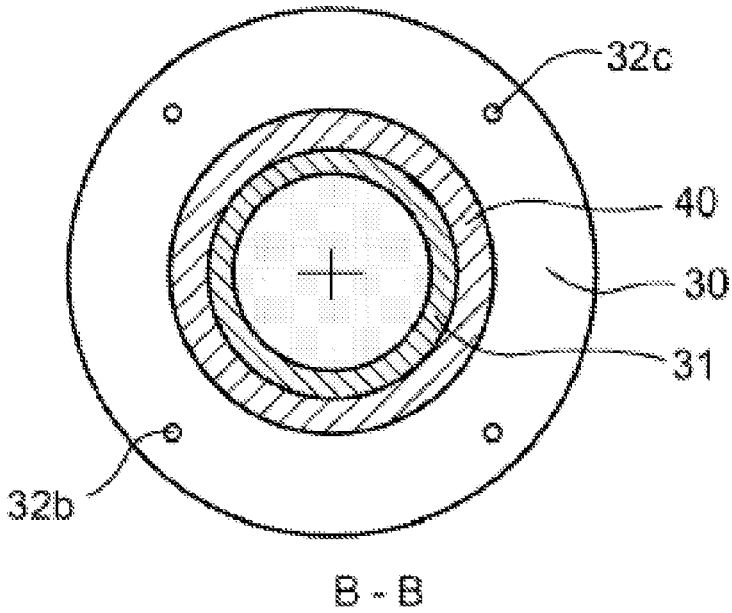
FIG. 5 is a transversal cross section B-B through the device of FIG. 4.

FIG. 4 shows a device according to one embodiment of the invention, comprising an anode 30 whose body is rotationally symmetrical and tubular and is intended to receive an object 31 to be coated. The object 31 is coated on the outside. FIG. 5 shows a transversal cross section B-B through the device of FIG. 4. The anode is made of a thick-walled tube of stainless steel. In the anode, channels 32*a-d* have been worked out through which electrolyte is supplied to the surface of the anode. On the inside of the tube, about 1 mm of the surface portion, which is to be insulated, is turned down. A 1 mm thick plastic tube, the inside diameter of which corresponds to the inside diameter of the anode, is sawn out so that the axial height corresponds to the axial height of the surface portion 33*a*. The piece of tube is cut out in the axial direction and is received by the surface portion 33*a* on the anode that has been turned down and the axial height of which corresponds to the axial height of the piece of plastic. The axial cut on the piece of plastic is then glued together. In the same way, pieces of plastic are prepared for the other surface portions 33*c*, 33*e*, which should also be electrically insulated. The device is designed to receive the object in such a way that the object constitutes a cathode and that, upon receipt of the object, a space 40 is formed for receiving a liquid-absorbing material and an electrolyte for coating the object.

The object is enclosed by two covers 34, 35. The device comprises two cylindrical plates 36, 37 arranged at each end of the object and connected to the object. Each one of the cylindrical plates is provided with a tap 38, 39. The object is brought to rotate relative to the anode by introducing a rotary motion via the taps 38, 39. The anode is connected galvanically to the positive pole of a dc unit and the tubular object 31 is connected to the negative pole of the same unit via any of the taps 38, 39.

The invention also comprises a method of coating an electrically conductive object with a metallic coating. An embodiment of the method will be described in the following with reference to FIG. 2. The first step of the method is degreasing of the object in order to clean the surface. The valves 28*a*, 28*e* of the tank 27*a* with degreasing liquid are opened and degreasing liquid is pumped from the tank into the anode 10. Through the channels 13*a-d* provided in the anode 10, the liquid is transported out into the surface of the anode and further out into the space 20 between the anode and the object, which comprises the liquid-absorbing material. The object is brought to rotate by transferring a moment to the tap 23. The rotation continues during all of the following steps of the method. A suitable speed of rotation is 25-100 revolutions per minute. Liquid passing through the liquid-absorbing material is drained out via the drainage holes 25*a-b* and flows back to the tank 27*a*. When degreasing liquid has been pumped around for about 3 minutes, the valves 28*a*, 28*e* for the tank with degreasing liquid are closed. The object has now been degreased. Alternatively, degreasing may take place separately in another degreasing device.

The second step of the method is rinsing of the object. The valves 28*d*, 28*h* for the water tank 27*d* are opened. Water is pumped around for about 3 minutes in order to rinse away any remaining degreasing liquid, whereupon the valves 28*d*, 28*h* for the water tank are closed.

The third step of the method is pickling of the object. The valves 28*b*, 28*f* for the tank 27*b* with pickling liquid are opened and pickling liquid is now pumped around for about 3 minutes, whereupon the valves 28*b*, 28*f* are closed. The object has now been pickled. Alternatively, pickling may take place separately in another pickling device.

The fourth step of the method is another rinsing operation. The valves 28*d*, 28*h* of the water tank are now opened again and water is pumped around for about 3 minutes in order to rinse away any remaining pickling liquid. Thereafter, the valves 28*d*, 28*h* of the water tank are closed. The object is now ready to receive a layer of metal.

The fifth step of the method is metal plating of the object. The valves 28*c*, 28*g* of the tank 27*c* with electrolyte are opened. The electrolyte is now pumped around through the channels 13*a-d* of the anode and out into those surface portions 12*a-e* that are to be coated and further back to the tank 27*c* again via the drainage holes 25*a-b*. The anode 10 is energized by connecting it galvanically to the positive pole of a current supply unit (not shown). The object is connected galvanically to the negative pole of the current supply unit. Amperage and time are adapted to the size of the surface portions that are to be coated and the desired layer thickness. Thereafter, the current is switched off and the valves 28*c*, 28*g* for the tank with electrolyte are closed. The voltage may be in the interval of 2-25 V. The surfaces which are opposite to the electrically conductive surfaces 12*b*, 12*d* on the anode 10 are coated with a layer of metal. The surfaces which are opposite to the electrically insulated surfaces 12*a*, 12*c*, 12*e* on the anode 10 remain uncoated. Thus, the metal plating is completed.

The sixth step of the method is rinsing of the object 1. The valves 28*d*, 28*h* of the water tank 27*d* are opened and water is pumped round through the anode and out into the liquid-absorbing material. Alternatively, all the rinsing steps may take place separately in another device.

The equipment also comprises a control device (not shown) for controlling the pump and the valves. The control device may, for example, be a computer.

The function of the anode is partly to constitute a structurally supporting element for the channels, and their outlets, through which electrolyte is supplied, to electrically conductive surface portions on the surface of the anode, partly to constitute the electrical positive pole during electrolytic coating. The diameter of the anode is determined such that, concentrically between the anode and the object to be surface-coated, a space is formed that is intended to receive a liquid-absorbing material. The function of the liquid-absorbing material is to take up and make available fresh electrolyte at the surface portions that are to be surface-coated. In this way, it is ensured that fresh electrolyte is supplied to the surface portions that are included as a positive pole in the electrolytic coating process.

The coating takes place under relative movement between the anode and the object to be coated. The relative movement has the function of ensuring that no burn-in effects are obtained on the layer. However, the relative movement must not be too fast since this may result in an unnecessarily slow rate of coating.

When coating more than one surface portion, the energization may take place at the same time for the different surface portions. The energization may also take place according to a certain sequence so that a first surface portion is energized first, whereupon a second surface portion is energized, whereby the energization of the first surface portion is interrupted. Thereafter, a third surface portion is energized, whereby the energization of the second surface portion is interrupted. Different combinations of energization in time, of the different surface portions, are possible. It is also possible to use different forms of direct current, for example pulsed direct current. The pulse length and the amplitude may then be determined based on the object to be surface-coated as well as on different process parameters.

The anode may comprise a large number of rotationally symmetrical surface portions, the height of which in the axial direction may be different.

The invention claimed is:

1. A device for metallic electrolytic coating of an object of electrically conductive material, wherein the object has at least two surface portions that are desired to be coated with layers of different thicknesses, the device comprising:

a rotationally symmetrical anode comprising a body, wherein the device is designed to receive the object in such a way that the object constitutes a cathode and the anode comprises at least two surface portions that have different electrical conductivity and that are arranged opposite to said surface portions of the received object, and upon receipt of the object by the device, a space is formed between the anode and the object for receiving an electrolyte for coating the object, wherein said space is arranged for receiving an electrolyte comprising a silver salt solution and comprises a liquid-absorbing material, wherein said anode comprises at least two channels extending therethrough for the supply of electrolyte out on the surface of said anode, whereby one channel opens out at one of said surface portions of the anode and another channel opens out at the other one of said surface portions of the anode, and wherein one of said channels has a cross-section area that is smaller than a cross-section area of another of said channels.

2. The device according to claim 1, wherein one of said surface portions of the anode has a conductivity that is near zero, and another one of said surface portions of the anode has a conductivity that is significantly greater than zero.

3. The device according to claim 1, wherein one of said surface portions of the anode has a first conductivity that is significantly greater than zero and another one of said surface portions of the anode has a second conductivity that is significantly greater than zero, the first conductivity being different from the second conductivity.

4. The device according to claim 1, wherein said anode and the object are adapted to rotate relative to each other.

5. The device according to claim 1, further comprising:

a degreaser configured to degrease the object to be coated.

6. The device according to claim 5, wherein said channels are adapted to distribute degreasing liquid out into said space.

7. The device according to claim 1, further comprising:

a pickler configured to carrying out pickling of the object.

8. The device according to claim 7, wherein said channels are adapted to distribute pickling liquid out into said space.

9. The device according to claim 1, wherein the object is rotationally symmetrical.

10. A method for metallic electrolytic coating of an object of electrically conductive material, wherein the object has at least two surface portions that are desired to be coated with layers of different thicknesses with at least one device comprising a rotationally symmetrical anode that has a body, wherein the device is designed to receive the object and the object constitutes a cathode, wherein said anode has an essentially constant diameter over the length opposite to said object, the method comprising:

receiving the object with the device, whereby a space is formed between said anode and the received object, placing said surface portions of the object opposite to at least two surface portions of the anode which have different electrical conductivity, adding liquid-absorbing material to said space, supplying an electrolyte comprising a silver salt solution to the space electrifying at least one of said surface portions of said anode, whereby coating to different layer thicknesses of said surface portions on the object is carried out, supplying electrolyte to the surface of said anode through at least two channels extending through the anode, whereby one channel opens out at one of said surface portions of said anode and the other channel opens out at the other one of said surface portions of said anode, and wherein a volume of flow per unit of time is smaller in one of said channels compared with another one of said channels.

11. The method according to claim 10, wherein said surface portions of said anode comprise a first surface portion that has a conductivity that is near zero, and a second surface portion has a conductivity that is significantly greater than zero, the second surface portion then being electrified.

12. The method according to claim 10, wherein said surface portions of said anode comprise a first and a second surface portion which have a conductivity that is significantly greater than zero, whereby both surface portions are electrified.

13. The method according to claim 12, wherein said first surface portion of said anode has a first conductivity and said second surface portion of said anode has a second conductivity, whereby the first conductivity differs from the second conductivity.

14. The method according to claim 13, wherein the method comprises electrifying said surface portions simultaneously, whereby simultaneous coating to different layer thicknesses of said surface portions on the object is carried out.

15. The method according to claim 10, further comprising:

rotating said anode and said object relative to each other.

16. The method according to claim 10, where the object is rotationally symmetrical.

* * * * *